United States Patent [19]

Backe et al.

[11] Patent Number: 4,545,201

[45] Date of Patent: Oct. 8, 1985

[54] CONTROL ARRANGEMENTS FOR REGULATING THE SPEED OF A HYDROSTATIC ENERGY CONSUMER

[75] Inventors: Wolfgang Backe, Aachen; Franz Weingarten, Frechen; Hubertus Murrenhoff, Aachen, all of Fed. Rep. of Germany

[73] Assignee: Linde Aktiengesellschaft, Wiesbaden, Fed. Rep. of Germany

[21] Appl. No.: 404,508

[22] Filed: Aug. 2, 1982

[30] Foreign Application Priority Data

Aug. 3, 1981 [DE] Fed. Rep. of Germany ..... 3130659

[51] Int. Cl.[4] ..... F16H 39/46

[52] U.S. Cl. ..... 60/420; 60/426; 60/429; 60/447

[58] Field of Search ..... 60/428, 425, 426, 420, 60/429, 430, 447

[56] References Cited

U.S. PATENT DOCUMENTS

| | | | |
|---|---|---|---|
| 3,866,420 | 2/1975 | Appel | 60/447 |
| 4,216,656 | 8/1980 | Hamma | 60/447 |
| 4,243,107 | 1/1981 | Shook | 60/429 |
| 4,398,869 | 8/1983 | Kirkham et al. | 60/447 |

FOREIGN PATENT DOCUMENTS

| | | | |
|---|---|---|---|
| 2739968 | 3/1979 | Fed. Rep. of Germany | 60/448 |

*Primary Examiner*—Robert E. Garrett
*Assistant Examiner*—John M. Husar
*Attorney, Agent, or Firm*—Buell, Ziesenheim, Beck & Alstadt

[57] ABSTRACT

Control arrangement for regulating the speed of movement of a hydrostatic energy consumer is provided in which the ratio between pressure supplied and power on the output side is constant, in particular, a piston capable of sliding in a cylinder connected to a pressure main line, characterized in that an initial hydrostatic displacement machine is connected between the pressure main line and the consumer and is coupled with a second hydrostatic displacement machine on the shaft side, the second hydrostatic displacement machine is adjustable with respect to its displacement volume per revolution and is connected on the one hand to the pressure main line and on the other hand to a chamber carrying a lower pressure, where the adjusting element of this second displacement machine is connected with an r.p.m.-regulating device.

8 Claims, 1 Drawing Figure

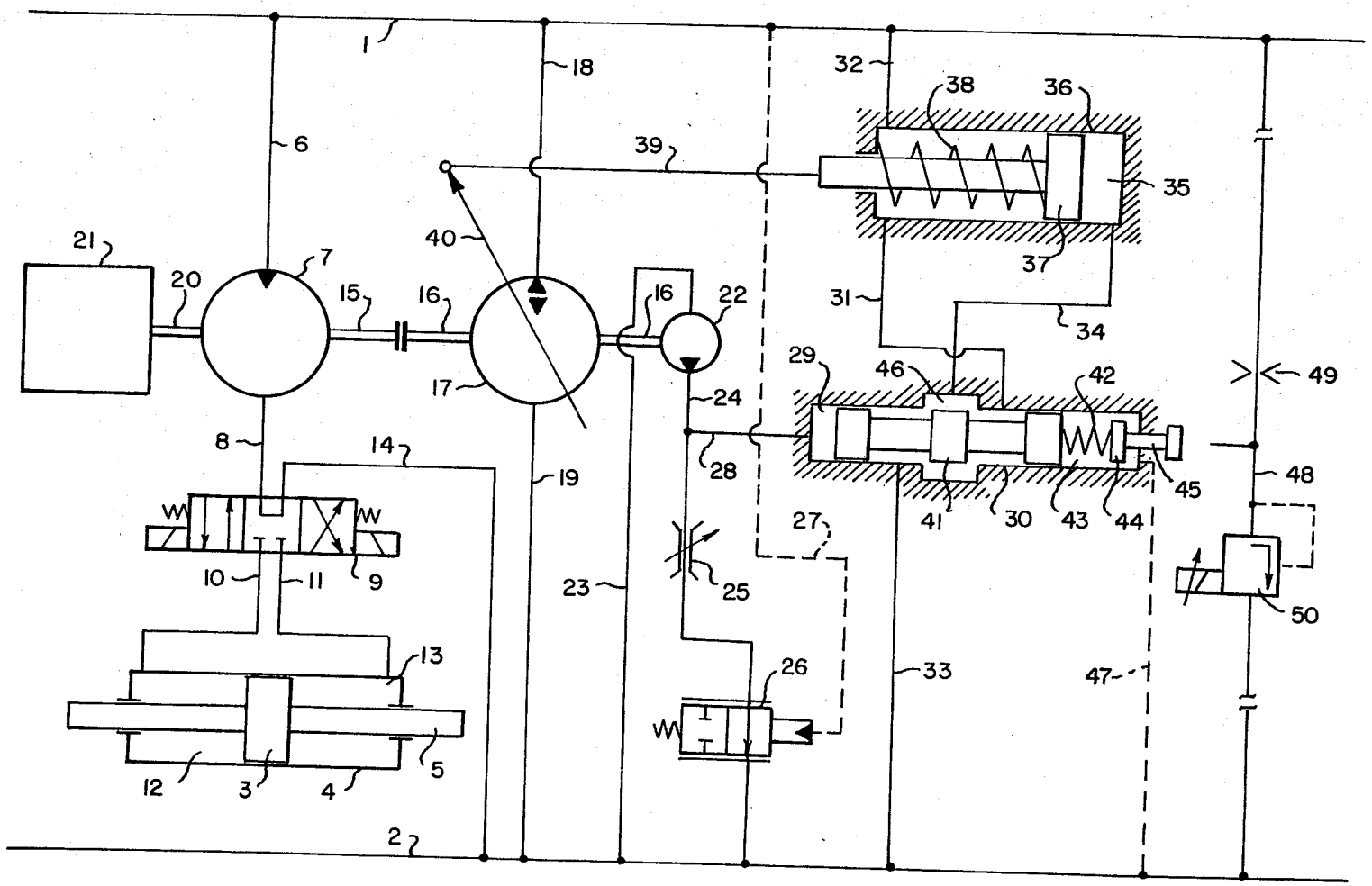
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50

CONTROL ARRANGEMENTS FOR REGULATING THE SPEED OF A HYDROSTATIC ENERGY CONSUMER

This invention relates to control arrangements for regulating the speed of a hydrostatic energy consumer and more particularly a control arrangement for regulating the speed of movement of a hydrostatic energy consumer, in which the ratio between pressure delivered and power (or, in rotational motion: torque) is constant on the power take-off side, e.g., of a constant piston motor or, in particular, a piston, preferably a piston or a rocking piston capable of sliding in a cylinder connected to a pressure main line with practically unlimited stream and pressure maintained as constant as possible, the piston being capable of swinging in a corresponding cylinder disk sector-shaped pressure chamber.

In a familiar system for regulating hydrostatic energy consumers connected to a pressure main line, a first control stream proportional to the speed of movement is generated and a second arbitrarily controlled control stream is generated and the differential value between the two control streams is fed to the controlling element of the adjustable hydrostatic energy consumer. If the consumer is a constant hydraulic motor with rotating shaft or a piston-cylinder system, an adjustable restrictor is actuated with the control signal. In order to generate the first control stream in the case where the consumer is a cylinder-piston system, a second cylinder in which a control stream generating piston positively coupled with the cylinder of the hydrostatic energy consumer for joint movement is capable of sliding is located alongside the cylinder. If the consumer is a hydraulic motor adjustable with respect to stroke volume per revolution, the ratio between pressure in the feed line and the torque at the output shaft is modified by varying the stroke volume per revolution and the torque at the output shaft can thus be adjusted to the torque absorbed by the mechanical energy consumer by regulating the stroke volume per revolution. In the case of a piston capable of sliding in a cylinder the ratio between piston power and pressure cannot be changed. The only method known to date for regulating the speed of movement of a piston capable of sliding in a cylinder was regulating the pressure and stream of the working medium flowing to the cylinder by throttling. But throttling involves energy loss and also a heating of the liquid working medium; consequently, costly measures have to be implemented for removing the heat.

The invention proposes to control the speed of movement of a piston capable of sliding in a cylinder with as low an energy loss as possible while avoiding restrictors.

This problem is solved by the features indicated in the characterization of claim 1. The two displacement machines can operate as pumps or motors. The stream flowing to the cylinder must thus flow through the first displacement machine, in which case a pressure gradient develops in the latter, just as at a restrictor, which is dependent on the torque at the shaft of this first displacement machine. This torque at the first displacement machine can however be arbitrarily adjusted by the torque absorption of the second adjustable displacement machine. While the energy is thus converted at a restrictor into non-useable heat which in contrast entails expenses with respect to its removal, the energy corresponding to the pressure difference is fed here to the shaft of the second displacement unit and again converted there into hydraulic energy that is fed to the pressure main line. The coupling together of two displacement machines, one of which is adjustable, for a stream divider is known. The use of such an arrangement for regulating the speed of movement of a piston in a hydrostatic system with impressed pressure, where the setting of the adjustable displacement machine is regulated in an r.p.m.-dependent manner, is however a novel, nonobvious solution. In the first displacement machine the energy stream is thus split into one portion that flows to the cylinder and another portion that flows back through the second displacement unit into the pressure main line. A portion of the energy is thus removed in the first displacement unit from the stream of pressure medium flowing to the cylinder and again fed to the pressure main line through conversion to mechanical energy and reconversion to hydraulic energy in the interim. In contrast to a restrictor, no energy losses develop here except as a result of the efficiency of the first and second displacement machines and the flow losses in the lines.

The system according to the invention is also applicable to piston-cylinder systems in which the piston is loaded in the same direction, independently of the direction of movement, e.g., the piston-cylinder system of an elevating platform, in which at least the dead weight of the platform rests on the piston even when it is being lowered. Braking must be effected in this case during lowering at a regulated speed and for this purpose it is necessary that the first displacement machine runs in a different direction of rotation in this state than when the platform is being raised. This necessitates the capability of the second displacement machine of swinging through a neutral position into the opposite direction, such that the first displacement machine, now running in the opposite direction of rotation, still drives the second displacement machine so that the latter feeds back into the pressure main line as a pump that is driven by the first displacement machine.

It is possible for a load to act on the piston rod of the piston-cylinder system during a specific direction of movement, at will in each of the two possible directions, and if it is to be possible to brake this load, a pressure gradient must be generated in the first displacement machine that is greater than the pressure gradient between the pressure main line and the tank from which the second displacement unit draws. In each such case in which it is braked through the first displacement unit appropriate switching measures should be provided for the control and regulation arrangement and the stroke volume per revolution of the second displacement unit must be greater than that of the first one since both are connected to the same pressure main line, thus are loaded on one side by the same pressure, but the energy throughout at the second displacement unit is greater than at the first.

A consumer that absorbs or gives off a torque can be connected to the shaft of the first displacement unit or to the common shaft of both displacement units; its r.p.m. is then always proportional to the speed of movement of the piston in the cylinder.

Additional advantageous refinements are indicated in the subclaims.

The invention also extends to arrangements in which a different hydraulic-mechanical energy converter is provided instead of the piston-cylinder system described, provided the ratio of pressure of the fluid delivered to the power or torque on the mechanical side is constant in it.

In the foregoing general description of our invention, we have set out certain objects, purposes and advantages of our invention. Other objects, purposes and advantages of this invention will be apparent from the following description and the accompanying drawing illustrating a circuit diagram of the arrangement according to the invention.

In the drawing the pressure main line 1 is supplied with pressure by a pump (not shown in the drawing), which is maintained at a high value that is as constant as possible. The line 2 leads to a pressureless tank. The piston 3 is capable of sliding in the cylinder 4, which with the piston rod 5 connected with the piston 3 serves to move a mechanical energy consumer. The movement speed of piston 3 in cylinder 4 is to remain constant at the value that is preselected by a control signal fed in, independently of the forces acting on the piston rod 5.

A branch line 6 leads from line 1 to the constant hydraulic motor 7, to the outlet of which a line 8 is connected; line 8 leads through an arbitrarily actuatable 3-position/4-connection valve (3/4-way valve) 9 to the two lines 10 and 11, line 10 of which is connected to the pressure chamber 12 of cylinder 4 and line 11 is connected to the pressure chamber 13 of cylinder 4. The line 14 is connected to the fourth connection of the 3-position/4-connection valve 9 and is also connected to line 2.

The shaft 15 of hydraulic motor 7 is connected with the shaft 16 of a pump 17 that is adjustable with respect to stroke volume per revolution. Pump 17 is connected through line 18 to the pressure main line 1 and also through line 19 to the line 2.

The hydraulic motor 7 is provided with a free shaft end 20, to which a consumer 21 can be connected for mechanical energy.

An auxiliary control pump (measuring pump) 22 is also connected to the shaft 16 of pump 17. A line 23 is connected to the suction connection of pump 22 and is also connected to line 2. An arbitrarily adjustable restrictor (measuring resistance) 25 and a hydraulically actuatable 2-position/2-connection valve 26 are connected in the delivery line 24 of auxiliary control pump 22. The control pressure chamber of valve 26 is connected through a control line 27 to the pressure main line 1. The delivery line 24 is also connected to line 2 so that a closed circuit 2, 23, 22, 24, 2 results.

A branch line 28 is connected to the delivery line 24 of the auxiliary control pump 22 between the latter and the restrictor 25; it leads to a pressure chamber 29 of a hydraulically regulated 3-position/3-connection control valve 30, from which a connection is made through lines 31 and 32 to the pressure main line 1 and a second connection is made through line 33 to line 2, while the third connection is connected through line 34 to the pressure chamber 35 of a controlling cylinder 36, in which a controlling piston 37 is capable of sliding against the force of a spring 38. The piston rod 39 of the controlling piston 37 is connected with the controlling element 40 of the adjustable pump 17.

A slide valve 41 is capable of sliding in the control valve 30 and one face of it is acted upon by the pressure in chamber 29, while the other face is supported against a spring 42 in a pressure chamber 43, where the spring 42 rests against a spring plate 44, which can be adjusted by means of a threaded journal 45 arbitrarily to set the pretension of spring 42.

In the position shown in the drawing the slide valve 41 is in its neutral position, in which its central valve piston component lies with negative overlapping in front of the groove 46, to which the line 34 is connected.

In the embodiment shown in the drawing the pressure chamber 44 is relieved of pressure through the line 47, which is connected to line 2. However, another embodiment is also possible, in which the line 47 is connected to another line through which a control pressure signal can be arbitrarily fed to the pressure chamber 44. For example, the line 47 in another embodiment can be connected to the line 48 between a restrictor 49 and an arbitrarily actuatable pressure-regulating valve 50.

The mode of operation is as follows: The speed of movement of piston 3 in cylinder 4 is determined by the stream that flows to cylinder 4 through line 8. This stream is determined by the r.p.m. of the constant hydraulic motor 7. Because its shaft 15 is rigidly coupled with the shaft 16 of adjustable pump 17, the r.p.m. of hydraulic motor 7 is determined by the r.p.m. of pump 17, which in turn determines the r.p.m. of auxiliary control pump 22, whose delivery stream is proportional to the r.p.m. of adjustable pump 17. In the delivery stream of auxiliary control pump 22, carried in delivery line 24, a pressure is retained in front of restrictor 25 that is proportional to the r.p.m. of the auxiliary control pump 22 and thus the r.p.m. of both the adjustable pump 17 and the hydraulic motor 7. This pressure head is thus also proportional to the stream that flows to cylinder 4 through line 8. This pressure head acts through line 28 also in the pressure chamber 29 and in the latter on the face of slide valve 41 and shifts it against the force of spring 42 to the right in the drawing (displacement path $x_v$). Through this displacement the connection between lines 34 and 33 is reestablished through the central piston section of slide valve 41 and thus the pressure chamber 35 is relieved of pressure, with the result that the controlling piston 7 is shifted to the right in the drawing (displacement path: y) under the effect of spring 38 and the pressure in pressure main line 1, which acts on the annular piston surface and is transfered through line 32, and thus the controlling element 40 of adjustable pump 17. If the piston 3 moves faster than prescribed by the setting of restrictor 25, the force generated by the pressure head in pressure chamber 29 on the face of slide valve 41 predominates, with the result that the slide valve is displaced in the manner just described. The controlling element 40 of the adjustable pump 17 is thus adjusted to a greater stroke volume per revolution, such that pump 17 absorbs a greater power and thus brakes the hydraulic motor 7 and thus reduces its r.p.m. and the stream flowing through the line 8.

Inversely, if the speed of movement of piston 3 decreases at a constant setting of restrictor 25, the pressure head in front of the latter drops and thus the pressure in pressure chamber 29, with the result that the slide valve 41 is shifted to the left in the drawing under the action of spring 42 and lines 31 and 34 are connected together, with the result that the pressure acting in pressure main line 1 acts on the large face of controlling piston 37, thus displacing the controlling piston 37 to the left in the drawing and adjusting the controlling element 40 of adjustable pump 17 to a smaller stroke volume per revolution, with the result that its power consumption and thus the braking action on the hydraulic motor 7 decrease.

The energy fraction removed from the stream flowing in line 6 in order to reduce the stream flowing in line 8 is thus fed through the hydraulic motor 7 and adjustable pump 17 and line 18 back into the pressure main line 1.

If a consumer of mechanical energy (load) 21 is connected to the shaft connection 20, its speed of movement is proportional to that of piston 3 and the energy fraction absorbed by this consumer 21 also acts to load the shaft of constant hydraulic motor 7 just as the torque absorbed by the shaft 16 of pump 17.

The setting given valve 9 determines the direction of movement or stoppage of piston 3. Because the hydraulic motor 7 is at the full pressure gradient between the lines 1 and 2 in the implementation example shown in the drawing at the position of valve 9 shown in the drawing, it can be expedient to design the valve 9 in another embodiment so that all four connections are shut off in its middle position.

If the pressure main line 1 is pressureless, valve 26 closes and thus facilitates a rapid buildup of pressure in line 24 and thus in line 28 in restarting. Also, if the pressure drops in the pressure main line 1, e.g., due to removal of an excessively great stream volume, this valve 26 is to intervene in the closed-loop control system so that the rated r.p.m. value is changed and the displacement unit 17 is adjusted to a small stroke volume per revolution and also if the r.p.m. drops here (r.p.m. interception).

It is provided that line 2 is always full by a pretensioned valve (not shown in the drawing) or by a pressureless tank at the appropriate height.

In the foregoing specification we have set out certain preferred embodiments and practices of this invention, however, it will be understood that this invention may be otherwise embodied within the scope of the following claims.

We claim:

1. Control arrangement for regulating the speed of movement of a hydrostatic energy consumer in which the ratio between pressure supplied and power on the output side is constant comprising a hydrostatic energy consumer having a constant ratio between power and pressure whose speed of movement is to be regulated, a high pressure hydraulic fluid supply capable of supplying several hydrostatic machines, a first hydrostatic displacement machine connected in series between the high pressure hydraulic fluid supply and the hydrostatic energy consumer, a second hydrostatic displacement machine mechanically coupled to the first hydrostatic machine, said second hydrostatic machine being adjustable with respect to its volumetric displacement per revolution, said second displacement machine being connected to the high pressure hydraulic fluid supply on one side, a low pressure hydraulic fluid line spaced from the high pressure supply, a connection between the second adjustable displacement machine and said low pressure line whereby fluid moves from the high pressure supply to the low pressure line through the second adjustable displacement machine independently of the hydrostatic energy consumer and revolution per minute regulating means connected to said second adjustable displacement machine for adjusting the displacement thereof in accordance with both the speed of rotation of said second adjustable displacement means and of the first displacement means mechanically coupled thereto thereby controlling the pressure fluid going to the energy consumer.

2. A control arrangement as claimed in claim 1 wherein the energy consumer is a piston.

3. A control arrangement as claimed in claim 1 wherein the first displacement machine is a hydraulic motor, and the second adjustable displacement machine is a hydraulic pump.

4. Control arrangement according to claim 1 or 2 or 3, characterized in that a consumer of mechanical rotation energy is connected to a shaft of the first displacement machine and driven thereby.

5. Control arrangement according to claim 1 or 2 or 3, characterized in that the second displacement machine is adjustable through a neutral position in both delivery directions.

6. Control arrangement according to claim 1 or 2 or 3, characterized in that the displacement volume per revolution of the second displacement machine is larger than that of the first displacement machine.

7. Control arrangement according to claim 5, characterized in that the displacement volume per revolution of the second displacement machine is larger than that of the first displacement machine.

8. Control arrangement according to claim 1 or 2 or 3, characterized in that the r.p.m. control arrangement has an auxiliary control pump mechanically coupled with and driven with the second adjustable displacement machine whose displacement volume per revolution is constant, a delivery line from said auxiliary control pump, a restrictor in the delivery line connected to the auxiliary control pump, and between the auxiliary control pump and the restrictor a branch line leads off to a pressure chamber of a hydraulically controlled regulating valve, which valve controls the loading of a control cylinder in which a control piston connected with an adjusting element of the second adjustable hydrostatic displacement machine is capable of sliding, and wherein the restrictor is arbitrarily adjustable and/or a control signal can be imposed on the control valve whereby the movement of the controlled regulating valve is regulated.

* * * * *

UNITED STATES PATENT AND TRADEMARK OFFICE

CERTIFICATE OF CORRECTION

PATENT NO. : 4,545,201

DATED : October 8, 1985

INVENTOR(S) : WOLFGANG BACKE, FRANZ WEINGARTEN, HUBERTUS MURRENHOFF

It is certified that error appears in the above-identified patent and that said Letters Patent is hereby corrected as shown below:

Column 1, line 17, after "the" insert --said--.

Column 6, line 15, after "piston" insert --sliding within a cylinder--.

Signed and Sealed this

*Seventh* Day of *January 1986*

[SEAL]

*Attest:*

DONALD J. QUIGG

*Attesting Officer*

*Commissioner of Patents and Trademarks*